US007611385B1

(12) United States Patent
Gao et al.

(10) Patent No.: US 7,611,385 B1
(45) Date of Patent: Nov. 3, 2009

(54) MEMORY CARD CONNECTOR

(75) Inventors: Ni Gao, Taipei Hsien (TW); Wei-Hong Liao, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/132,866

(22) Filed: Jun. 4, 2008

(51) Int. Cl.
*H01R 24/00* (2006.01)

(52) U.S. Cl. ..... 439/630; 439/638

(58) Field of Classification Search ..... 439/638, 439/630

See application file for complete search history.

(56) References Cited

U.S. PATENT DOCUMENTS 6,097,605 A * 8/2000 Klatt et al. ..... 361/737
6,468,101 B2 * 10/2002 Suzuki ..... 439/326
7,014,484 B2 * 3/2006 Hagiwara ..... 439/159
7,361,056 B1 * 4/2008 Liu ..... 439/630
7,371,120 B1 * 5/2008 Wu et al. ..... 439/636
7,409,225 B2 * 8/2008 Kim et al. ..... 455/558

* cited by examiner

*Primary Examiner*—Truc T Nguyen
(74) *Attorney, Agent, or Firm*—WPAT, P.C.; Anthony King; Kay Yang

(57) ABSTRACT

A memory card connector includes an insulating housing, a plurality of terminals received in the insulating housing, and a shell. The insulating housing has a base. The base defines a first edge, a second edge contiguous to the first edge, a third edge and a fourth edge contiguous to the third edge. The shell has a top plate, a first side plate and a second side plate respectively extending downward from two contiguous margins of the top plate. The shell covers on the insulating housing with the first side plate and the second side plate respectively secured to the first edge and the second edge such that a chamber is formed between the shell and the insulating housing, a first insertion opening is defined between the top plate and the third edge of the insulating housing, and a second insertion opening is defined between the top plate and the fourth edge of the insulating housing.

20 Claims, 5 Drawing Sheets

MEMORY CARD CONNECTOR

BACKGROUND OF THE INVENTION

1. Field of the Invention

The present invention relates to a memory card connector, and particularly to a memory card connector which is convenient for the insertion and the extraction of a memory card.

2. The Related Art

A conventional memory card connector is designed in accordance with appearance of a memory card, the memory card is longitudinally inserted into the corresponding memory card connector. The memory card needs to be inserted into or extracted out from the memory card connector frequently in the practical application. However, the conventional memory card connector is not convenient for the insertion and the extraction of the memory card when the conventional memory card connector is assembled together with other components in an electronic device. In addition, the conventional memory card connector with a single insertion direction also affects the normal arrangement with other components. So the conventional memory card connector cannot meet requirement for the manufacture of electronic devices at present and restrains a new design for an electronic device.

SUMMARY OF THE INVENTION

Accordingly, an object of the present invention is to provide a memory card connector with duplex insertion direction. The memory card connector includes an insulating housing, a plurality of terminals received in the insulating housing, and a shell. The insulating housing has a base. The base defines a first edge, a second edge contiguous to the first edge, a third edge and a fourth edge contiguous to the third edge. The shell has a top plate, a first side plate and a second side plate respectively extending downward from two contiguous margins of the top plate. The shell covers on the insulating housing with the first side plate and the second side plate respectively secured to the first edge and the second edge such that a chamber is formed between the shell and the insulating housing, a first insertion opening is defined between the top plate and the third edge of the insulating housing, and a second insertion opening is defined between the top plate and the fourth edge of the insulating housing.

As described above, the memory card connector is capable of providing two insertion directions, which is convenient for the insertion and the extraction of a memory card. Furthermore, the memory card connector can be adapted to address the problem that the electronic device using a conventional memory card connector with a single insertion direction is difficult to be assembled and designed.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENTS

Figure 1:
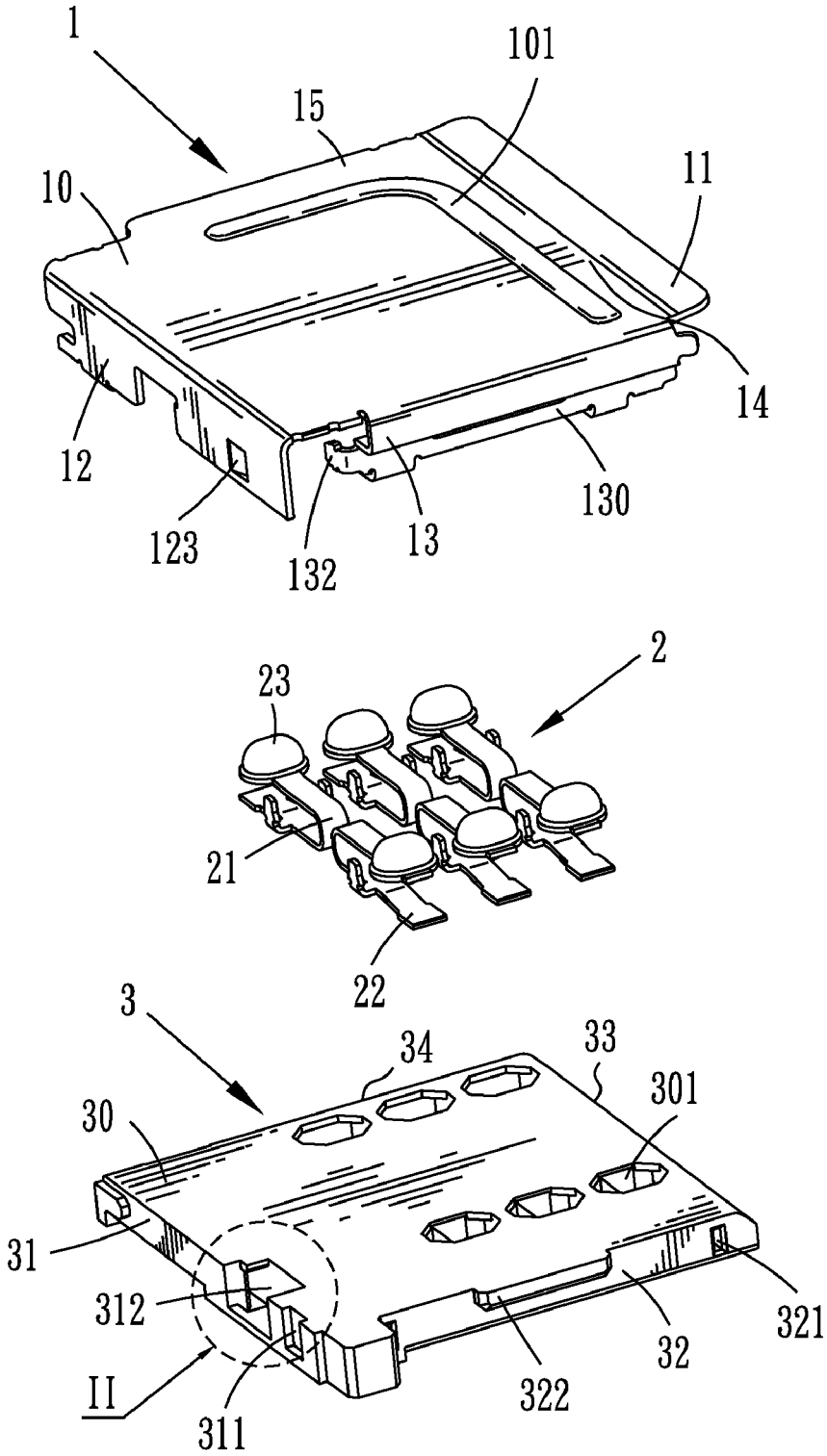
FIG. 1 is an exploded view of a memory card connector according to an embodiment of the present invention.
Figure 2:
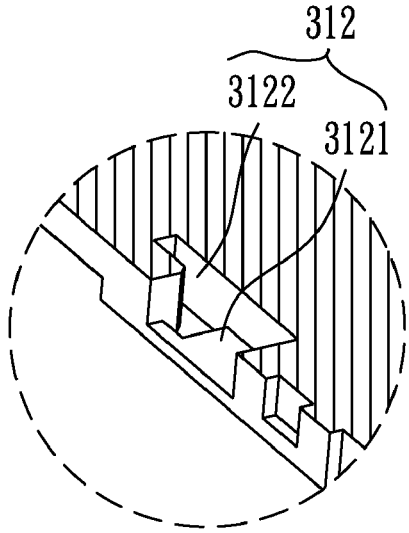
FIG. 2 is a partial cross-sectional view for clearly showing an L-shaped slot of an insulating housing shown in FIG. 1.
Figure 3:
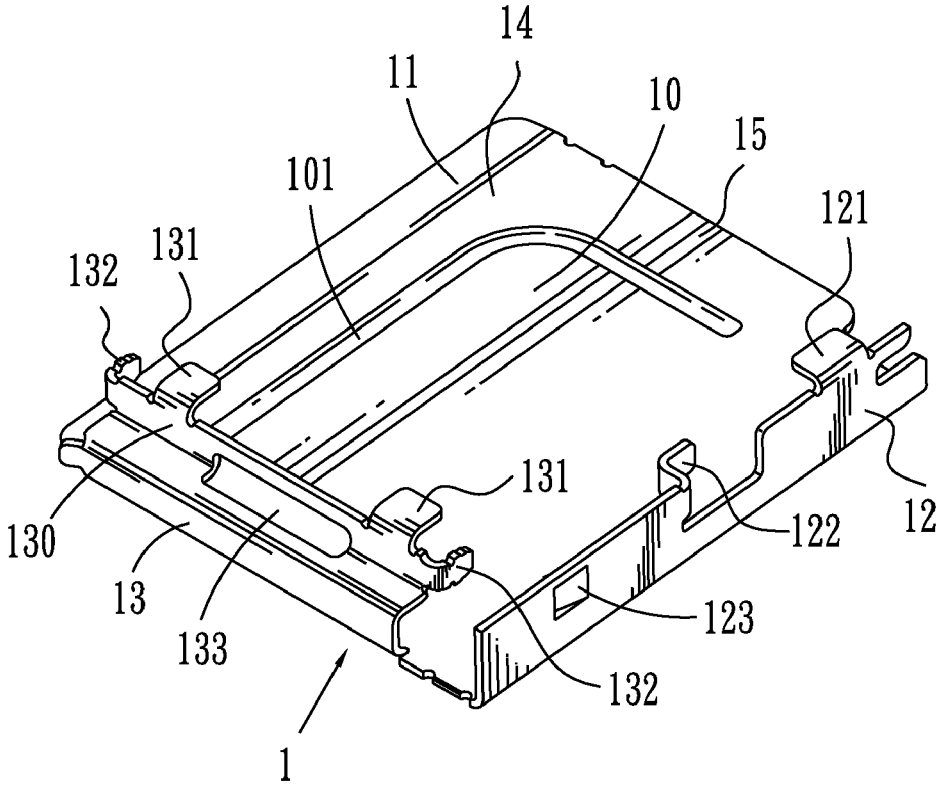
FIG. 3 is a perspective view of a shell of the memory card connector shown in FIG. 1 seen from the bottom direction.

With reference to FIG. 1, FIG. 2 and FIG. 3, the memory card connector includes an insulating housing 3, a plurality of terminals 2 received in the insulating housing 3 and a shell 1 mating with the insulating housing 3.

The shell 1 includes a top plate 10 of oblong shape, a first side plate 12 and a second side plate 13 respectively extending downward from two contiguous margins of the top plate 10. The top plate 10 defines a third side 14 near the second side plate 13 and a fourth side 15 contiguous to the third side 14, and has an L-shaped rib 101 protruding upward from a surface thereof near to the third side 14 and the fourth side 15. The third side 14 of the top plate 10 bends upward and extends to form an eave 11. The first side plate 12 includes a first buckling piece 121 bending inward and extending from a bottom thereof, an L-shaped leading portion 122 and a jamming piece 123. The L-shaped leading portion 122 is punched inward and then bends vertically toward the fourth side 15. The jamming piece 123 is punched inward from an end of the first side plate 12. The second side plate 13 which is substantially L-shaped defines a clamping plate 130. The clamping plate 130 has two second buckling pieces 131 extending inward from a bottom thereof, two catches 132 respectively extending inward from both ends thereof, and a rectangular hole 133 formed in the middle thereof.

The terminal 2 punched with metal plate defines a substantially U-shaped bending arm 21. One end of the bending arm 21 inclines downward and then extends horizontally to form a soldering portion 22. The soldering portion 22 is soldered to a printed circuit board (not shown). And the other end of the bending arm 21 extends upward to form a contact portion 23 of contact dome shape.

The insulating housing 3 defines a base 30 which is a flat-board shape. The base 30 includes a plurality of holes 301 adapted for receiving the terminals 2, a first edge 31, a second edge 32 contiguous to the first edge 31, a third edge 33 and a fourth edge 34 contiguous to the third edge 33. The first edge 31 of the insulating housing 3 has an L-shaped slot 312 corresponding to the L-shaped leading portion 122, and a recess 311 corresponding to the jamming piece 123. The L-shaped slot 312 defines a first slot 3121 capable of receiving the L-shaped leading portion 122, and a second slot 3122. One end of the second slot 3122 connects an inside of the first slot 3121, the other end of the second slot 3122 extends towards the fourth edge 34 for receiving a free end of the L-shaped leading portion 122. The second edge 32 has two grooves 321 corresponding to the catches 132 and a bump 322 extending outward from the middle thereof for mating with the rectangular hole 133.

Figure 4:
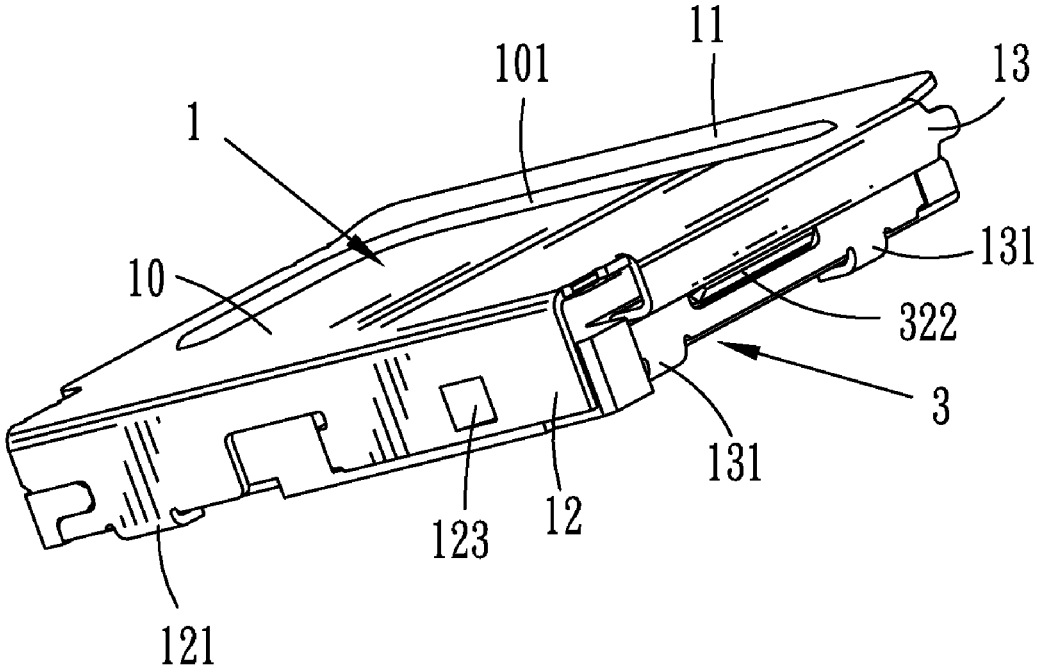
FIG. 4 is an assembled view of the memory card connector shown in FIG. 1.
Figure 5:
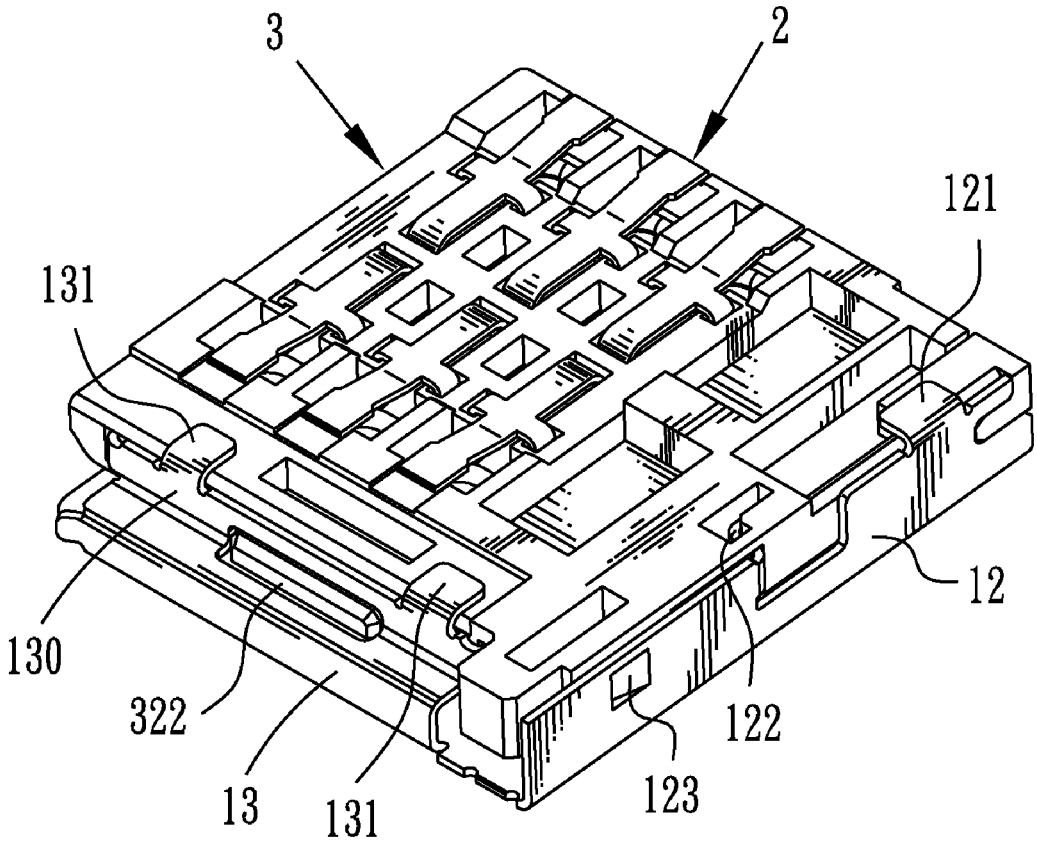
FIG. 5 is an assembled view of the memory card connector shown in FIG. 4 seen from the bottom direction.

Referring to FIG. 4 and FIG. 5, in assembly, the L-shaped leading portion 122 is placed in the first slot 3121 of the L-shaped slot 312, at this time, the first edge 31 of the insulating housing 3 is against the first side plate 12 of the shell 1. Then the L-shaped leading portion 122 is moved in the L-shaped slot 312 accompanying with the free end of the L-shaped leading portion 122 gradually inserting into the second slot 3122 to lead the shell 1 to mate with the insulating housing 3. In this process, the jamming piece 123 of the shell 1 jams into the recess 311 of the insulating housing 3 and the clamping plate 130 abuts against the second edge 32 of the insulating housing 3 to prevent the insulating housing 3 from moving left and right with respect to the shell 1, the catches 132 of the shell 1 jam into the grooves 321 of the insulating housing 3 and the rectangular hole 133 couples with the bump 322 for prevent the insulating housing 3 relevant to the shell 1 from moving forward and backward, the first buckling piece 121 and the second buckling pieces 131 buckle to the bottom of the insulating housing 3 for prevent the insulating housing 3 from moving upward and downward with respect to the shell 1.

Figure 6:
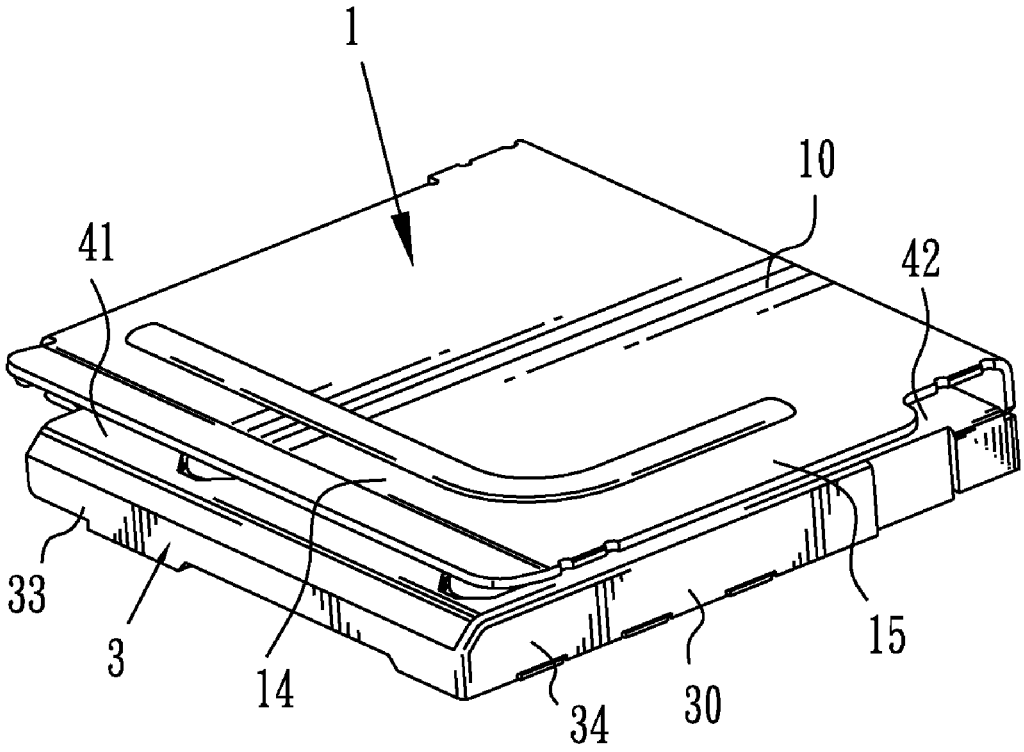
FIG. 6 is another assembled view of the memory card connector shown in FIG. 4.

Referring to FIG. 6, after the shell 1 assembled to the insulating housing 3, a chamber is formed between the shell 1 and the insulating housing 3. A first insertion opening 41 is formed between the third side 14 and the third edge 33, and a second insertion opening 42 is formed between the fourth side 15 and the fourth edge 34. The first insertion opening 41 and the second insertion opening 42 communicate with each other. The contact portion 23 of the terminal 2 is exposed in the chamber to connect with the terminal module of a memory card (not shown). The eave 11 is used as a guide. That is, the memory card is easily inserted into the chamber from the first insertion opening 41 or the second insertion opening 42 of the memory card connector along the eave 11. And the rib 101 of the top plate 10 can reduce the deformation of the shell 1 in the process of inserting the memory card.

As described above, the memory card can be inserted into the memory card connector along the transverse and longitudinal direction, which is convenient for the insertion and the extraction of the memory card and addresses the problem that the electronic device using a conventional memory card connector with a single insertion direction is difficult to be assembled and designed. Furthermore, the assembling structure of the memory card connector is sample and compact, which reduces space that the memory card connector occupies in an electronic device.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A memory card connector, comprising:

an insulating housing having a base, the base defining a first edge, a second edge contiguous to the first edge, a third edge and a fourth edge contiguous to the third edge;

a plurality of terminals received in the base; and a shell having a top plate, a first side plate and a second side plate extending downward from two contiguous margins of the top plate, the shell covering on the insulating housing with the first side plate and the second side plate respectively secured to the first edge and the second edge such that a chamber is formed between the shell and the insulating housing, a first insertion opening is defined between the top plate and the third edge of the insulating housing, and a second insertion opening is defined between the top plate and the fourth edge of the insulating housing, wherein a side of the top plate opposite the first side plate extends outward and inclines upward to form an eave.

2. The memory card connector as claimed in claim 1, wherein the first side plate has a portion punched inward and then bending toward a direction opposite the second side plate to form an L-shaped leading portion, the first edge of the insulating housing defines an L-shaped slot corresponding to the L-shaped leading portion, the L-shaped leading portion is slidably received in the L-shaped slot.

3. The memory card connector as claimed in claim 1, wherein the first edge of the insulating housing defines a recess, the first side plate defines a jamming piece punched inward, the jamming piece jams into the recess of the insulating housing to prevent the insulating housing from moving.

4. The memory card connector as claimed in claim 1, wherein the first side plate defines a first buckling piece extending inward from a bottom thereof to fasten the insulating housing.

5. The memory card connector as claimed in claim 1, wherein both ends of the second edge of the insulating housing respectively define a groove, the second side plate of the shell has two catches extending inward from both ends thereof, the catches jam into the grooves of the second edge.

6. The memory card connector as claimed in claim 1, wherein the second side plate has a rectangular hole in the middle thereof, the second edge has a bump extending outward therefrom corresponding to the rectangular hole for coupling with the rectangular hole.

7. The memory card connector claimed as in claim 1, wherein the terminal has a contact portion formed as a contact dome at a free end thereof and exposed in the chamber.

8. The memory card connector as claimed in claim 1, wherein the first insertion opening and the second insertion opening communicate with each other.

9. The memory card connector as claimed in claim 1, wherein the top plate of the shell protrudes upward to form an L-shaped rib near the first insertion opening and the second insertion opening.

10. A memory card connector, comprising:

an insulating housing having a base, the base defining a first edge, a second edge contiguous to the first edge, a third edge and a fourth edge contiguous to the third edge;

a plurality of terminals received in the base; and a shell having a top plate, a first side plate and a second side plate extending downward from two contiguous margins of the top plate, the shell covering on the insulating housing with the first side plate and the second side plate respectively secured to the first edge and the second edge such that a chamber is formed between the shell and the insulating housing, a first insertion opening is defined between the top plate and the third edge of the insulating housing, and a second insertion opening is defined between the top plate and the fourth edge of the insulating housing, wherein the first side plate has a portion punched inward and then bending toward a direction opposite the second side plate to form an L-shaped leading portion, the first edge of the insulating housing defines an L-shaped slot corresponding to the L-shaped leading portion, the L-shaped leading portion is slidably received in the L-shaped slot.

11. The memory card connector as claimed in claim 10, wherein the first insertion opening and the second insertion opening communicate with each other.

12. The memory card connector as claimed in claim 10, wherein the top plate of the shell protrudes upward to form an L-shaped rib near the first insertion opening and the second insertion opening.

13. The memory card connector as claimed in claim 10, wherein the first edge of the insulating housing defines a recess, the first side plate defines a jamming piece punched inward, the jamming piece jams into the recess of the insulating housing to prevent the insulating housing from moving.

14. The memory card connector as claimed in claim 10, wherein the first side plate defines a first buckling piece extending inward from a bottom thereof to fasten the insulating housing.

15. The memory card connector as claimed in claim 10, wherein both ends of the second edge of the insulating housing respectively define a groove, the second side plate of the shell has two catches extending inward from both ends thereof, the catches jam into the grooves of the second edge.

16. The memory card connector as claimed in claim 10, wherein the second side plate has a rectangular hole in the middle thereof, the second edge has a bump extending outward therefrom corresponding to the rectangular hole for coupling with the rectangular hole.

17. A memory card connector, comprising:

an insulating housing having a base, the base defining a first edge, a second edge contiguous to the first edge, a third edge and a fourth edge contiguous to the third edge;

a plurality of terminals received in the base; and a shell having a top plate, a first side plate and a second side plate extending downward from two contiguous margins of the top plate, the shell covering on the insulating housing with the first side plate and the second side plate respectively secured to the first edge and the second edge such that a chamber is formed between the shell and the insulating housing, a first insertion opening is defined between the top plate and the third edge of the insulating housing, and a second insertion opening is defined between the top plate and the fourth edge of the insulating housing, wherein both ends of the second edge of the insulating housing respectively define a groove, the second side plate of the shell has two catches extending inward from both ends thereof, the catches jam into the grooves of the second edge.

18. The memory card connector as claimed in claim 17, wherein the first edge of the insulating housing defines a recess, the first side plate defines a jamming piece punched inward, the jamming piece jams into the recess of the insulating housing to prevent the insulating housing from moving.

19. The memory card connector as claimed in claim 17, wherein the first side plate defines a first buckling piece extending inward from a bottom thereof to fasten the insulating housing.

20. The memory card connector as claimed in claim 17, wherein the second side plate has a rectangular hole in the middle thereof, the second edge has a bump extending outward therefrom corresponding to the rectangular hole for coupling with the rectangular hole.

* * * * *